US006880736B1

(12) United States Patent
Gnepper

(10) Patent No.: US 6,880,736 B1
(45) Date of Patent: Apr. 19, 2005

(54) DISPENSING CLOSURE, PACKAGE AND METHOD OF MANUFACTURE

(75) Inventor: Maurice R. Gnepper, Fremont, OH (US)

(73) Assignee: Owens-Illinois Closure Inc., Toledo, OH (US)

( * ) Notice: Subject to any disclaimer, the term of this patent is extended or adjusted under 35 U.S.C. 154(b) by 277 days.

(21) Appl. No.: 10/252,917

(22) Filed: Sep. 23, 2002

(51) Int. Cl.[7] ..... B65D 47/00
(52) U.S. Cl. ..... 222/556
(58) Field of Search ..... 222/556, 566, 222/571, 547, 568; 215/235; 220/836, 837

(56) References Cited

U.S. PATENT DOCUMENTS

| | | | | |
|---|---|---|---|---|
| 3,059,816 | A | 10/1962 | Goldstein | |
| 3,168,221 | A | 2/1965 | Parker | |
| 4,377,247 | A | 3/1983 | Hazard | |
| 4,709,823 | A | 12/1987 | Beck | |
| 4,793,501 | A | 12/1988 | Beck | |
| 5,007,555 | A | 4/1991 | Beck | |
| 5,065,911 | A | 11/1991 | Rohr | |
| 5,386,918 | A * | 2/1995 | Neveras et al. | 222/556 |
| 5,547,091 | A | 8/1996 | Neveras | |
| 5,913,435 | A | 6/1999 | Fuchs | |
| 6,041,477 | A | 3/2000 | Rentsch | |
| 6,257,431 | B1 | 7/2001 | Baudin | |
| 6,321,923 | B1 | 11/2001 | Wood | |
| 6,349,860 | B1 * | 2/2002 | McMahon et al. | 222/556 |
| 6,367,670 | B1 | 4/2002 | Warner | |
| 6,454,130 | B1 * | 9/2002 | Miller et al. | 222/556 |
| 6,478,184 | B1 * | 11/2002 | Berge et al. | 222/556 |
| 6,510,971 | B1 * | 1/2003 | Martin | 222/556 |
| 6,766,926 | B1 * | 7/2004 | Elchert | 222/556 |
| 2002/0096532 | A1 * | 7/2002 | Berge et al. | 222/556 |

FOREIGN PATENT DOCUMENTS

| | | | |
|---|---|---|---|
| EP | 44570 | A1 * | 1/1982 |
| EP | 0621199 | | 10/1994 |
| EP | 621199 | A1 * | 10/1994 |
| GB | 2224309 | | 5/1990 |

OTHER PUBLICATIONS

U.S. Appl. No. 10/208,443, filed Jul. 29, 2002.

* cited by examiner

*Primary Examiner*—Kenneth Bomberg

(57) ABSTRACT

A dispensing closure includes a closure base having a base wall, a skirt with an axis and at least one internal thread or bead for securing the closure to a container finish. A deck is raised with respect to the closure base wall and has an arcuate convex external surface at an angle to the axis of the skirt to prevent the puddling of moisture on the upper or external surface of the deck. A dispensing opening is disposed in the deck, and a lid is integrally connected to the closure base by at least one hinge.

18 Claims, 4 Drawing Sheets

DISPENSING CLOSURE, PACKAGE AND METHOD OF MANUFACTURE

The present invention is directed to dispensing closures for fluid products such as beverages, food condiments and body lotions, to dispensing packages that include such closures, and to methods of making such closures.

BACKGROUND AND SUMMARY OF THE INVENTION

Fluid dispensing closures typically are comprised of a one-piece integrally molded structure that includes a base and a lid integrally connected to the base by one or more hinge elements. The base includes a dispensing opening through which product may be dispensed in the open position of the lid, and through which dispensing is blocked in the closed position of the lid. U.S. Pat. Nos. 4,638,916, 5,489,035 and 5,913,435 illustrate dispensing closures of this type. It is a general object of the present invention to provide a dispensing closure, a dispensing closure and container package, and a method of making a dispensing closure, in which accumulation of moisture on the deck of the closure base is retarded, which achieve smooth product dispensing and cut-off, and/or in which a trap is provided on the underside of the closure base to prevent the dispensing of condensed or separated liquid (e.g., water or vinegar) ahead of a viscous fluid product such as ketchup or mustard.

A dispensing closure in accordance with one aspect of the present invention includes a closure base having a base wall, a skirt with an axis and at least one internal thread or bead for securing the closure to a container finish. A deck is raised with respect to the closure base wall and has an arcuate convex external surface at an angle to the axis of the skirt to prevent the puddling of moisture on the upper or external surface of the deck. A dispensing opening is disposed in the deck, and a lid is integrally connected to the closure base by at least one hinge.

A dispensing closure in accordance with an exemplary preferred embodiment of the invention includes a base and a lid integrally connected to the base by at least one hinge. The base includes an annular base wall, and a skirt extending from an outer peripheral edge of the base wall with one or more internal threads or beads for securing the closure to a container finish. A deck has a peripheral wall extending from an inner peripheral edge of the base wall in a direction opposite the skirt, and a deck wall extending across an edge of the peripheral wall spaced from the base wall. The deck has an arcuate convex external surface at an angle to the axis of the skirt. A dispensing opening is disposed in the deck wall surrounded by an annular wall upstanding from the deck wall. The annular wall has an outer edge spaced from the deck wall and lying in a plane at an angle to the axis of the skirt. The point on the edge of the annular wall remote from the hinge is at the greatest distance from the deck wall. The angulated edge of the annular wall forms a spout that facilitates dispensing and cut-off of product through the dispensing opening.

Other aspects of the present invention contemplate a closure and container package that includes a container and a dispensing closure in accordance with an aspect of the invention discussed above, and a method of making a dispensing closure by integrally molding the closure in accordance with one of the aspects of the invention discussed above.

BRIEF DESCRIPTION OF THE DRAWINGS

The invention, together with additional objects, features and advantages thereof, will be best understood from the following description, the appended claims and the accompanying drawings in which:

DETAILED DESCRIPTION OF PREFERRED EMBODIMENTS

Figure 1:
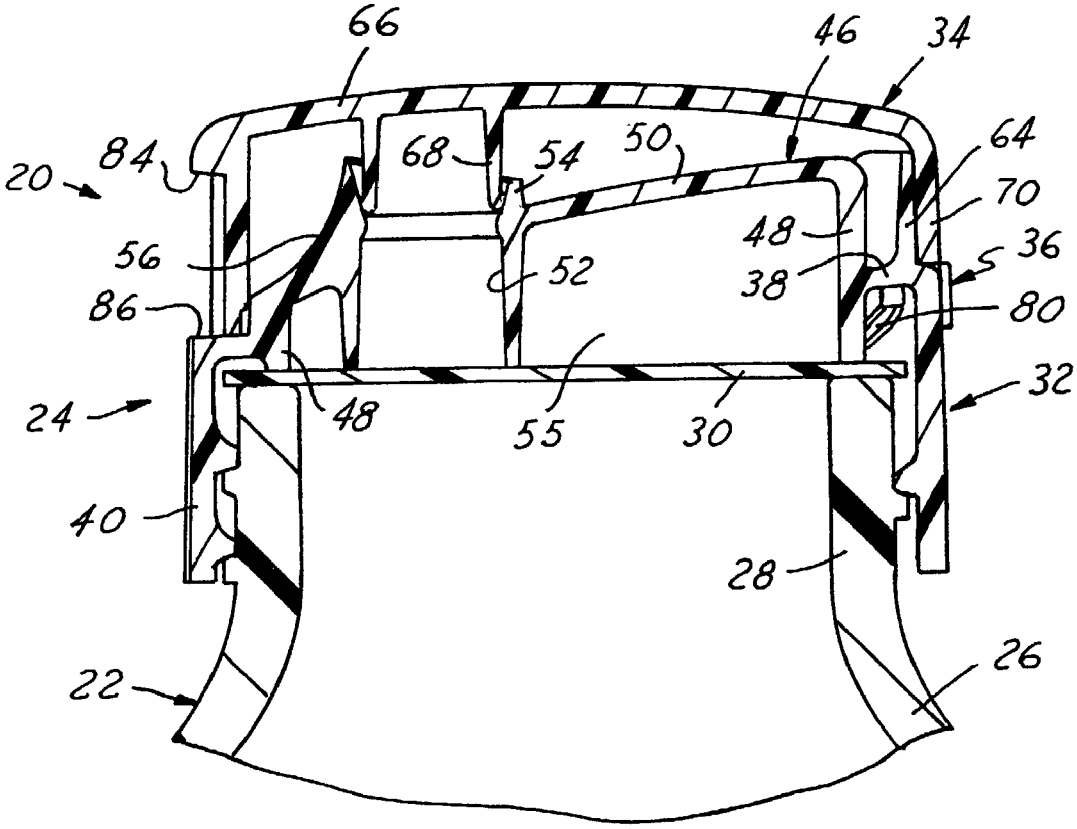
FIG. 1 is a fragmentary sectional view of a closure and container package in accordance with one presently preferred embodiment of the invention.
Figure 2:
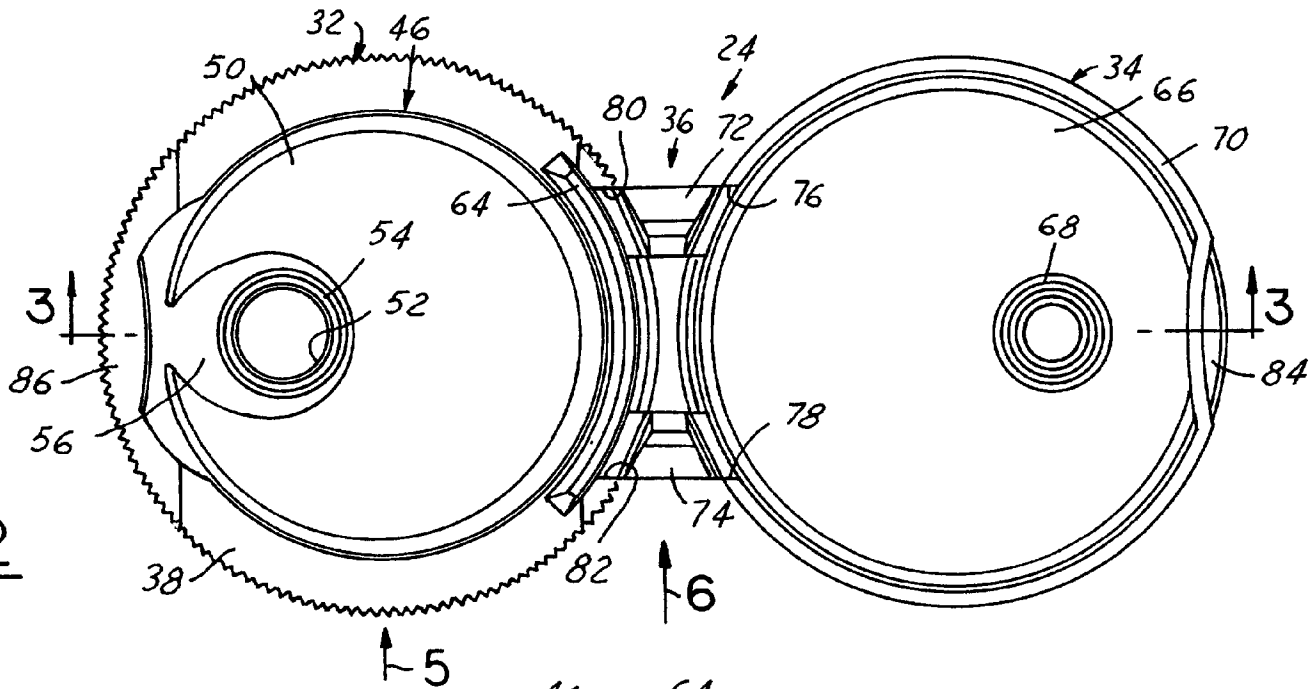
FIG. 2 is a top plan view of the closure in FIG. 1 as molded with the closure lid in the open position.
Figure 3:
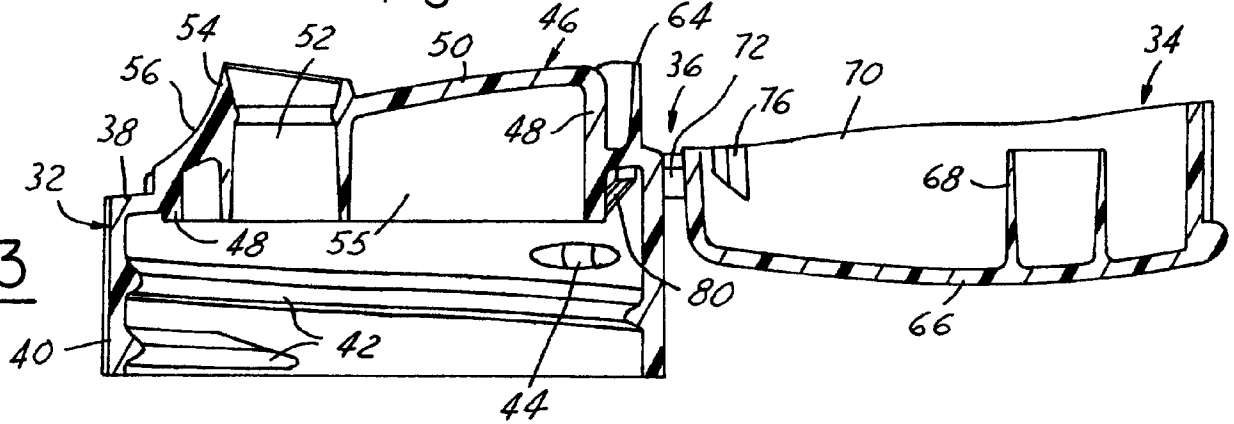
FIG. 3 is a sectional view taken substantially along the line 3—3 in FIG. 2.
Figure 4:
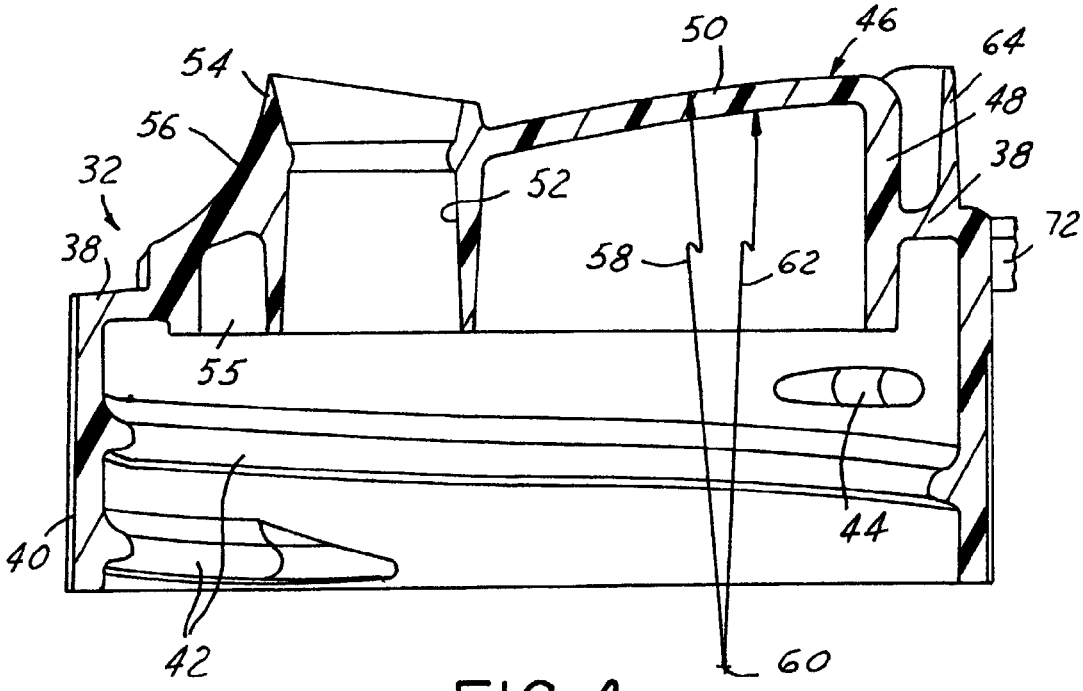
FIG. 4 is a fragmentary sectional view on an enlarged scale of the closure base in FIG. 3.

FIG. 1 illustrates a closure and container package 20 in accordance with one presently preferred embodiment of the invention as including a container 22 and a dispensing closure 24. Container 22 includes a body 26 from which a cylindrical finish 28 extends. Body 26 may be of any suitable geometry. A sealing liner disk 30 is captured between closure 24 and the end surface of container finish 28. Liner disk 30 may be of any suitable construction, such as a multilayer disk that is heat sealed to the upper surface of the container finish, which must be removed to dispense product from the container.

Figure 5:
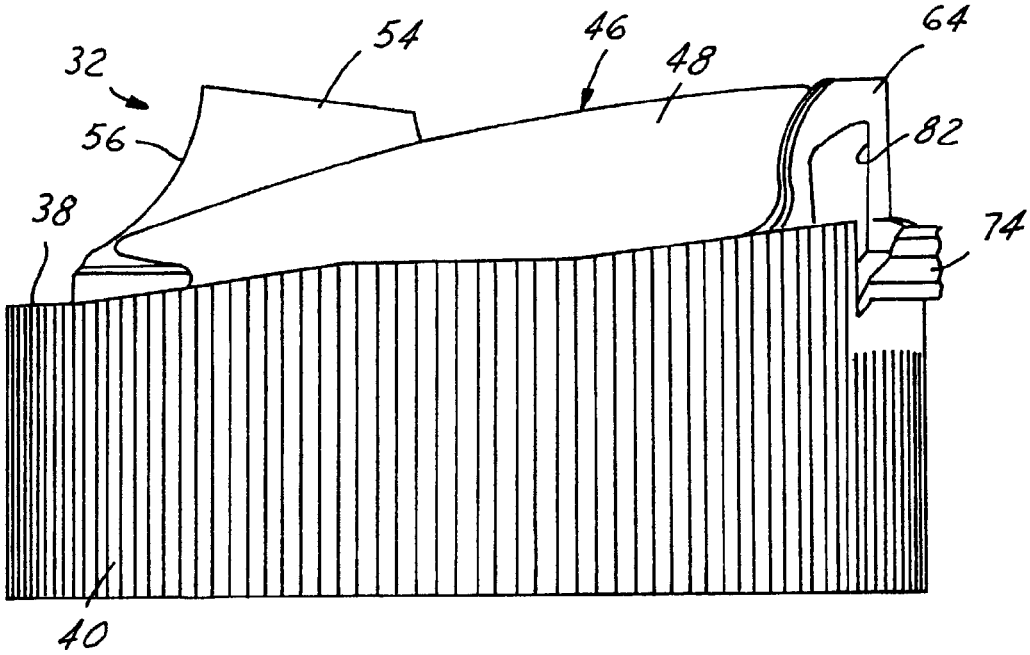
FIG. 5 is a fragmentary elevational view of the closure base, being taken substantially from the direction 5 in FIG. 2.
Figure 6:
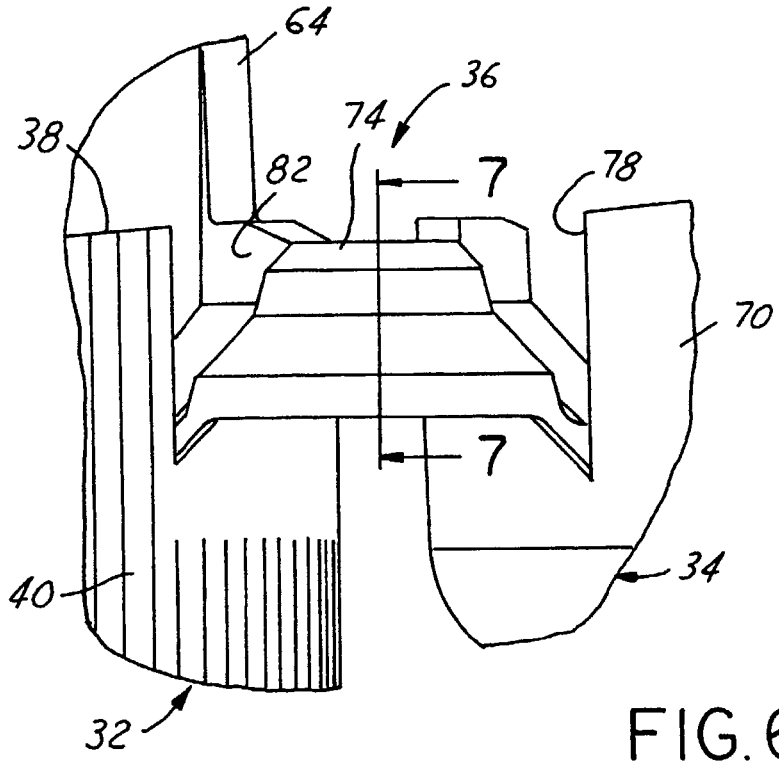
FIG. 6 is a fragmentary elevational view of the closure hinge, being taken substantially from the direction 6 in FIG. 2.
Figure 7:
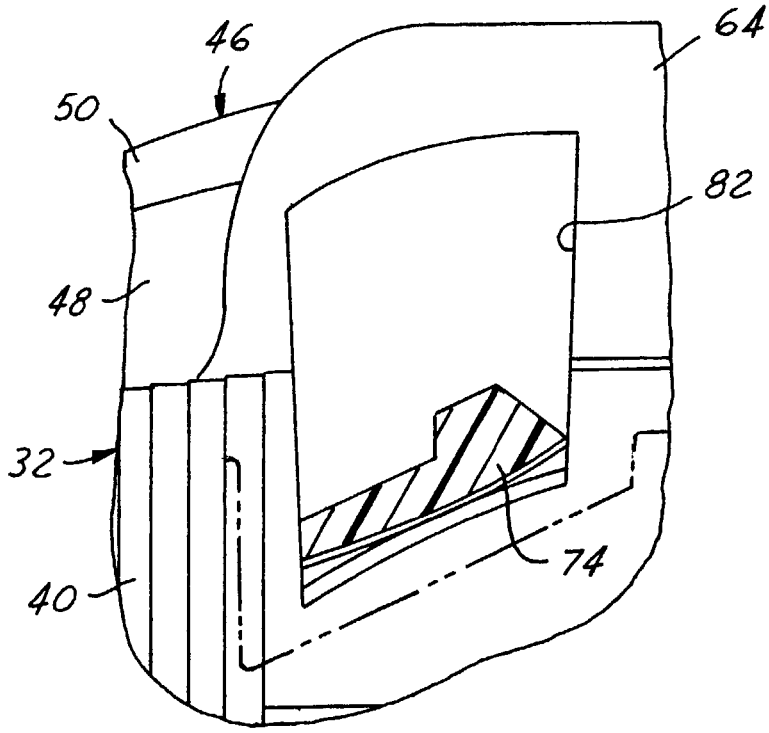
FIG. 7 is a fragmentary sectional view taken substantially along the line 7—7 in FIG. 6.

The drawings illustrate that dispensing closure 24 includes a base 32 and a lid 34 integrally connected to the base by a hinge 36. Hinge 36 may comprise one or more hinge elements. Closure base 32 includes an annular base wall 38. Base wall 38 may be planar or stepped (FIG. 5). A skirt 40 extends from the outer peripheral edge of annular base wall 38, and has one or more internal threads or beads 42 for securing the closure to container finish 28 (FIG. 1). One or more circumferentially spaced lugs 44 may also be provided on the internal surface of skirt 40 for holding liner disk 30 (FIG. 1) in position within the closure skirt until the closure is assembled to the container finish. A deck 46 is upstanding from closure base wall 38. (Directional words such as "upstanding" and "upwardly" are employed by way of description and not limitation with respect to the upright orientation of the closure and package illustrated in FIGS. 1 and 3–7. Directional words such as "axial" and "radial" are employed by way of description and not limitation with respect to the central axis of container finish 28 or closure skirt 40 as applicable.) Deck 46 includes a peripheral wall 48 that extends upwardly from the inner peripheral edge of closure base wall 38, and a deck wall 50 that extends across the upper edge of peripheral wall 48. Deck peripheral wall 48, extending from the inner peripheral edge of annular base wall 38, is spaced radially inwardly from skirt 40, which extends from the outer peripheral edge of the annular base wall. Deck peripheral wall 48 preferably is cylindrical (discounting draft angle) and coaxial with skirt 40.

A dispensing opening 52 extends through deck wall 50. In the illustrated embodiment of the invention, dispensing opening 52 is circular and offset from the axis of peripheral skirt 40 in a direction away from hinge 36. Dispensing opening 52 is surrounded by an annular wall 54 that extends both upwardly from deck wall 50, and downwardly or inwardly from the deck wall. The upper or outer end of annular wall 54 lies in a plane at an angle with respect to the axis of the closure skirt, preferably at an angle of 92° with respect to the skirt axis. The high point of wall 54 is at a position remote from hinge 36. This outlet wall configuration forms a spout that facilitates dispensing and cut-off of fluid product through dispensing opening 52. From this forward edge of wall 54, an arcuate surface 56 extends downwardly and outwardly to the adjacent edge of deck peripheral wall 48. An annular cavity 55 is formed between the inner portion of annular wall 54 (i.e., beneath deck wall 50) and peripheral wall 48. Annular cavity 55 functions to trap water, vinegar or other liquid that condenses or separates on the upper surface of fluid to be dispensed, such as mustard or ketchup, and prevents dispensing of such liquid along with the product.

The remainder of deck wall 50 (that is, excluding annular wall 54 and arcuate surface 56) has an exterior surface that is arcuate and convex, and at an angle to the axis of the closure skirt. Stated differently, the upper edge of deck peripheral wall 48 is at an angle to the skirt axis, and deck wall 50 that extends around the upper edge of the peripheral wall is therefore likewise at an angle to the axis of the peripheral skirt. This angle slopes downwardly toward base wall 38 in the direction away from hinge 36. The outer surface of deck wall 50 preferably is at a uniform radius 58 (FIG. 4) from a point 60 spaced beneath the closure base. The inner surface of deck wall 50 is likewise at a uniform radius 62 measured from point 60, so that deck wall 50 is of uniform thickness determined by the difference between radii 58, 62. In one preferred embodiment of the invention for a 33 mm container finish, radius 58 is about 3.164 inches and radius 62 is about 3.124 inches, leaving deck wall 50 with a thickness of about 0.040 inch. A part-annular arcuate wall 64 is upstanding from base wall 38 adjacent to hinge 36 and adjacent to the outer peripheral edge of the base wall.

Lid 34 includes a base wall 66 from which an annular wall 68 extends to form a spud for plug-sealing engagement within dispensing opening 52 to seal the dispensing opening in the closed position of the lid (FIG. 1). Lid 34 also includes a peripheral wall 70. Hinge 36 in the preferred embodiment of the invention comprises a pair of laterally spaced hinge elements 72, 74 of the construction illustrated in U.S. Pat. No. 6,041,477, the disclosure of which is incorporated herein by reference. A pair of interruptions or gaps 76, 78 are formed in lid peripheral wall 70 to receive hinge elements 72, 74 in the closed position of the lid. Likewise, a pair of pockets 80, 82 are formed in skirt 40 of base 32 to receive the hinge elements in the closed position of the lid. Part-annular wall 64 is disposed adjacent to the peripheral edge of base wall 38 for abutting engagement with the internal surface of lid peripheral wall 70 in the closed position of the lid (FIG. 1) to retard entry of moisture through interruptions 76, 78 into the area between the lid and deck 46. This operation of upstanding wall 64 is described in greater detail in copending U.S. application Ser. No. 10/208,443 filed Jul. 29, 2002, which is assigned to the assignee of the present application and incorporated herein by reference. Lid 34 is provided with a thumb recess 84, which is aligned with a corresponding thumb recess 86 on base 32 in the closed position of the lid, for manually opening the lid from the closed position illustrated in FIG. 1 to the open position illustrated in FIGS. 2–7.

There has thus been disclosed a dispensing closure, a dispensing closure and container package and a method of manufacture that fully achieve all of the objects and aims previously set forth. The invention has been disclosed in conjunction with a presently preferred embodiment thereof, and a number of modifications and variations have been discussed. Other modifications and variations will readily suggest themselves to persons of ordinary skill in the art. For example, the closure base and lid are of circular geometry in the disclosed embodiment of the invention. However, the closure base could be a double skirt-type base, having an inner cylindrical skirt for securement to a container finish and an outer skirt (and deck and lid) of any desired geometry (e.g., oval) to blend with the contour of the container sidewall. The invention is intended to embrace all such modifications and variations as fall within the spirit and broad scope of the appended claims.

What is claimed is:

1. A dispensing closure that includes:

a closure base having a base wall, a skirt with an axis and internal means for securing the closure to a container finish, a deck that is raised with respect to said base wall and has an arcuate convex external surface at an angle to the axis of said skirt, and a dispensing opening in said deck, and a lid integrally connected to said base by at least one hinge, said deck including a peripheral wall extending from said deck to said base wall, said peripheral wall having a greatest dimension parallel to said axis adjacent to said hinge and a minimum dimension parallel to said axis remote from said hinge, said peripheral wall of said deck being spaced radially inwardly from a peripheral edge of said base wall, and being cylindrical and coaxial with said skirt.

2. A dispensing closure that includes:

a closure base having a base wall, a skirt with an axis and internal means for securing the closure to a container finish, a deck that is raised with respect to said base wall and has an arcuate convex external surface at an angle to the axis of said skirt, and a dispensing opening in said deck, and a lid integrally connected to said base by at least one hinge, said deck including a peripheral wall extending from said deck to said base wall, said peripheral wall having a greatest dimension parallel to said axis adjacent to said hinge and a minimum dimension parallel to said axis remote from said hinge, said peripheral wall of said deck being spaced radially inwardly from a peripheral edge of said base wall, said base including an upstanding arcuate part-annular wall extending from said base wall between said peripheral wall and said peripheral edge adjacent to said hinge.

3. The closure set forth in claim 2 wherein said peripheral wall is cylindrical and coaxial with said skirt.

4. The closure set forth in claim 1 wherein said deck has internal and external arcuate surfaces at constant radii from a common center, such that said deck has a uniform wall thickness.

5. The closure set forth in claim 1 wherein said base includes an upstanding arcuate part-annular wall extending from said base wall between said peripheral wall and said peripheral edge adjacent to said hinge.

6. The closure set forth in claim 2 wherein said lid has a peripheral skirt with at least one interruption at said at least one hinge, and said upstanding wall is disposed on said base wall for internal surface engagement with said skirt at said interruption in a closed position of said lid to block entry of moisture through said interruption.

7. The closure set forth in claim 2 wherein said closure base includes an annular wall upstanding from said deck surrounding said dispensing opening, said annular wall having an edge spaced from said deck that lies in a plane at an angle to said axis.

8. The closure set forth in claim 7 wherein said base includes an arcuate forward surface extending from an edge of said annular wall remote from said hinge to a position adjacent to said base wall.

9. The closure set forth in claim 2 wherein said closure base includes an annular wall depending from said deck and surrounding said dispensing opening, and an annular cavity between said annular wall and said peripheral wall.

10. A dispensing closure that includes:

a base and a lid integrally connected to said base by at least one hinge, said base including an annular base wall, a skirt extending from an outer peripheral edge of said base wall and having internal means for securing the closure to a container finish, a deck having a peripheral wall extending from an inner peripheral edge of said base wall in a direction opposite said skirt and a deck wall extending across an edge of said peripheral wall spaced from said base wall, said deck wall having an arcuate convex external surface at an angle to said axis, and a dispensing opening in said deck wall surrounded by an annular wall upstanding from said deck wall, said annularwall having an outer edge spaced from said deck wall, said outer edge lying in a plane at an angle to said axis such that said edge has a point remote from said hinge at greatest distance from said deck wall.

11. The closure set forth in claim 10 wherein said annular wall surrounding said dispensing opening continues beneath said deck wall and forms an annular cavity between said annular wall and said peripheral wall.

12. The closure set forth in claim 10 wherein said base includes an arcuate forward surface extending from an edge of said annular wall remote from said hinge to a position adjacent to said base wall.

13. A closure and container package that includes:

a container having a finish and a dispensing closure that comprises:

a base and a lid integrally connected to said base by at least one hinge, said base including an annular base wall, a skirt extending from an outer peripheral edge of said base wall and having internal means for securing the closure to a container finish, a deck having a peripheral wall extending from an inner peripheral edge of said base wall in a direction opposite said skirt and a deck wall extending across an edge of said peripheral wall spaced from said base wall, said deck wall having an arcuate convex external surface at an angle to said axis, and a dispensing opening in said deck wall surrounded by an annular wall upstanding from said deck wall, said annular wall having an outer edge spaced from said deck wall, said outer edge lying in a plane at an angle to said axis such that said edge has a point remote from said hinge at greatest distance from said deck wall.

14. The package set forth in claim 13 wherein said annularwall surrounding said dispensing opening continues beneath said deckwall and forms an annular cavity between said annular wall and said peripheral wall.

15. The package set forth in claim 13 wherein said base includes an arcuate forward surface extending from an edge of said annular wall remote from said hinge to a position adjacent to said base wall.

16. A method of making a dispensing closure that includes integrally molding a closure base and a closure lid connected to said base by at least one hinge, said closure base including an annular base wall, a skirt extending from an outer peripheral edge of said base wall and having internal means for securing the closure to a container finish, a deck having a peripheral wall extending from an inner peripheral edge of said base wall in a direction opposite said skirt and a deck wall extending across an edge of said peripheral wall spaced from said base wall, said deck wall having an arcuate convex external surface at an angle to said axis, and a dispensing opening in said deck wall surrounded by an annular wall upstanding from said deck wall, said annular wall having an outer edge spaced from said deck wall, said outer edge lying in a plane at an angle to said axis such that said edge has a point remote from said hinge at greatest distance from said deck wall.

17. The method set forth in claim 16 wherein said annular wall surrounding said dispensing opening continues beneath said deckwall and forms an annularcavity between said annular wall and said peripheral wall.

18. The method set forth in claim 16 wherein said peripheral wall is cylindrical and coaxial with said skirt.

* * * * *